US007145294B2

(12) United States Patent
Liao et al.

(10) Patent No.: US 7,145,294 B2
(45) Date of Patent: Dec. 5, 2006

(54) DETECTING APPARATUS FOR COLD CATHODE LAMP

(75) Inventors: Tai-Shan Liao, Taichung (TW); Long-Jeng Lee, Hsinchu (TW); Chi-Hung Hwang, Hsinchu (TW); Ji-Jur Huang, Hsinchu (TW); Jung-Hsing Wang, Hsinchu (TW); Feng-Chang Hsu, Hsinchu (TW)

(73) Assignee: Precision Instrument Development Center, Hsinchu (TW)

( * ) Notice: Subject to any disclaimer, the term of this patent is extended or adjusted under 35 U.S.C. 154(b) by 135 days.

(21) Appl. No.: 10/958,808

(22) Filed: Oct. 5, 2004

(65) Prior Publication Data

US 2005/0212460 A1 Sep. 29, 2005

(30) Foreign Application Priority Data

Mar. 23, 2004 (TW) ..... 93107855 A

(51) Int. Cl.
*H05B 37/02* (2006.01)

(52) U.S. Cl. ..... 315/291

(58) Field of Classification Search ..... 315/291, 315/308, 307, 224

See application file for complete search history.

(56) References Cited

U.S. PATENT DOCUMENTS

| | | | | |
|---|---|---|---|---|
| 5,747,942 | A * | 5/1998 | Ranganath | 315/224 |
| 6,362,575 | B1 * | 3/2002 | Chang et al. | 315/224 |
| 6,559,645 | B1 * | 5/2003 | Arndt et al. | 324/329 |
| 6,667,585 | B1 * | 12/2003 | O'Meara | 315/291 |
| 2002/0140352 | A1 * | 10/2002 | Sakai et al. | 313/633 |
| 2003/0142305 | A1 * | 7/2003 | Bungo | 356/319 |
| 2005/0068534 | A1 * | 3/2005 | Kleinfeld et al. | 356/417 |

* cited by examiner

*Primary Examiner*—Shih-Chao Chen
*Assistant Examiner*—Minh Dieu A
(74) *Attorney, Agent, or Firm*—Volpe and Koenig, P.C.

(57) ABSTRACT

A detecting apparatus for a lamp is disclosed. The detecting apparatus includes a central processing unit for receiving a spectrum signal and converting the spectrum signal into a digital signal, a converter for converting the digital signal to an analog signal, a controller for receiving the analog signal and generating an operating signal, and an amplifier for receiving the operating signal and outputting a voltage signal to activate the lamp, wherein the spectrum signal is analyzed and differentiated such that an operating condition for the lamp is obtained.

5 Claims, 1 Drawing Sheet

DETECTING APPARATUS FOR COLD CATHODE LAMP

FIELD OF THE INVENTION

This invention relates to a detecting apparatus for a lamp, and more particularly to a detecting apparatus being able to adjust the operating frequency and voltage of the cold cathode lamp.

BACKGROUND OF THE INVENTION

The cold cathode lamp has many advantages, such as smaller lamp tubes, simpler structures, less temperature increase, higher brightness on the surface of the lamp, being easily manufactured in different shapes, and long lifespans. Due to such specific properties, it has been widely applied in many kinds of applications, such as the liquid crystal display, notebook, mobile phone, scanner, and backlight source product.

A cold cathode lamp is a tube having the mercury vapor and inert gas therein and the two ends thereof have electrodes. In addition, the inner wall of the cold cathode lamp is covered with the fluorescent substance. The principle of luminescence is some of the electrons in the tube will be activated and hit the electrodes, and the secondary electrons would be induced accordingly after a high voltage is supplied into the electrodes. When the activated electrons collide with the mercury atoms, the mercury atoms would be stimulated and the ultraviolet would be emitted therefrom. The ultraviolet will stimulate the fluorescent substance covered on the inner wall of the tube to perform the visible light with the relative color temperature. The color of visible light is based on the covered fluorescent substance.

The performance of the cold cathode lamp depends on the operating frequency and voltage. The properties of each cold cathode lamp are different, so that it is inconvenient to adjust the operating frequency of the cold cathode lamp in a manufacturing process of the backlight source product. The operating principles for the driving circuits of the cold cathode lamp is that a high voltage transformer is applied to produce a fixed voltage, and the operating frequency of the cold cathode lamp is determined by changing the capacitance or resistance. Hence, the effect of the driving circuits of the cold cathode lamp on adjusting the backlight source product in the production line is limited.

Therefore, if the cold cathode lamp could be proceeded with the continuous frequency scan and voltage scan first before being used, it would be possible to observe the vapor properties and the optical spectrum strengths of the cold cathode lamp on the spectrometer. In addition, the most economic and effective methods for determining the optimal conditions of the key electronic components in the driving circuit of the cold cathode lamp are also the objects of the present study.

As above, the present invention provides a detecting apparatus for a lamp so as to obtain the optimal operating frequency and voltage and adjust the lamp into the optimal condition for overcoming the disadvantages of the prior art described above.

SUMMARY OF THE INVENTION

It is an aspect of the present invention to provide a detecting apparatus to scan a cold cathode lamp and obverse the vapor properties and the optical spectrum strengths of the lamp on the spectrometer in order to find out the optimal operating frequency and voltage and decide the optimal condition for the driving circuits on the capacitance, resistance or the ratio of coil on the transformer.

Another aspect of the present invention includes to avoid the defect that the new component for the driving circuits fails to fit the cold cathode lamp, and to save the timing on the quality control for the cold cathode lamp backlight source product in the production line. The disadvantages in the above descriptions could be overcome accordingly. By observing the changing of vapor properties and the optical spectrum strengths of the lamp on the spectrometer with the continuous frequency scan and amplitude scan, the optimal operating frequency and voltage would be found out quickly.

The further aspect of the present invention is to control the voltage amplitude and light of the cold cathode lamp by a voltage controller. The cold cathode lamp is lighten by the different voltages and the dynamic ranges of operating response from the linear voltage amplifier. When the spectrum properties of the cold cathode lamp are differentiated by the spectrometer, the optimal operating frequency and voltage of the cold cathode lamp would be easily determined accordingly.

In accordance with the aspect of the present invention, the detecting apparatus for a lamp is provided. The detecting apparatus includes a central processing unit for receiving a spectrum signal and converting the spectrum signal into a digital signal, a converter for converting the digital signal to an analog signal, a controller for receiving the analog signal and generating an operating signal, and an amplifier for receiving the operating signal and outputting a voltage signal to activate the lamp, wherein the spectrum signal is analyzed and differentiated such that an operating condition for said lamp is obtained.

Preferably, the lamp is a cold cathode lamp.

Preferably, the operating detecting apparatus further includes a spectrometer for receiving a light from a lamp and generating a spectrum signal.

Preferably, the condition is an optimal operating frequency and a voltage.

Preferably, the converter is a digital/analog transmitter.

Preferably, the controller is a voltage-controlled frequency and gain controller.

Preferably, the amplifier is a voltage operational amplifier.

Preferably, the detecting apparatus includes a display for showing said condition.

Preferably, the detecting apparatus includes a resistance between the amplifier and the lamp for protecting the amplifier.

Preferably, the detecting apparatus includes a lens positioned between the lamp and the spectrometer for focusing the light from the lamp and transmitting the light to the spectrometer though an optical fiber.

In accordance with the another aspect of the present invention, a detecting apparatus for a lamp is provided. The detecting apparatus includes a central processing unit for receiving a spectrum signal and converting the spectrum signal into a digital signal, a converter for converting the digital signal to an analog signal, a controller for receiving the analog signal and generating an operating signal, an amplifier for receiving the operating signal and outputting a voltage signal to activate the lamp, a display for displaying a condition, a spectrometer for receiving a light from the lamp and generating a spectrum signal, and a lens between the lamp and a spectrometer for focusing the light from the lamp and transmitting to the spectrometer though an optical fiber, wherein the spectrum signal is analyzed and differentiated such that an operating condition for the lamp is obtained.

Preferably, the lamp is a cold cathode lamp.

Preferably, the operating condition is an optimal operating frequency and a voltage.

Preferably, the converter is a digital/analogy transmitter.

Preferably, the detecting apparatus includes a resistance between the amplifier and the lamp for protecting a amplifier.

In accordance with the another aspect of the present invention, a detecting apparatus for a lamp is provided. The detecting apparatus includes a central processing unit for receiving a spectrum signal and converting the spectrum signal into a digital signal, a converter for converting the digital signal to an analog signal, and a controller for receiving a analog signal and generating an operating signal, wherein the spectrum signal is analyzed and differentiated such that an operating condition for the lamp is obtained.

Preferably, the lamp is a cold cathode lamp.

Preferably, the operating condition is an optimal operating frequency and a voltage.

Preferably, the controller is a voltage-controlled frequency and gain controller.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
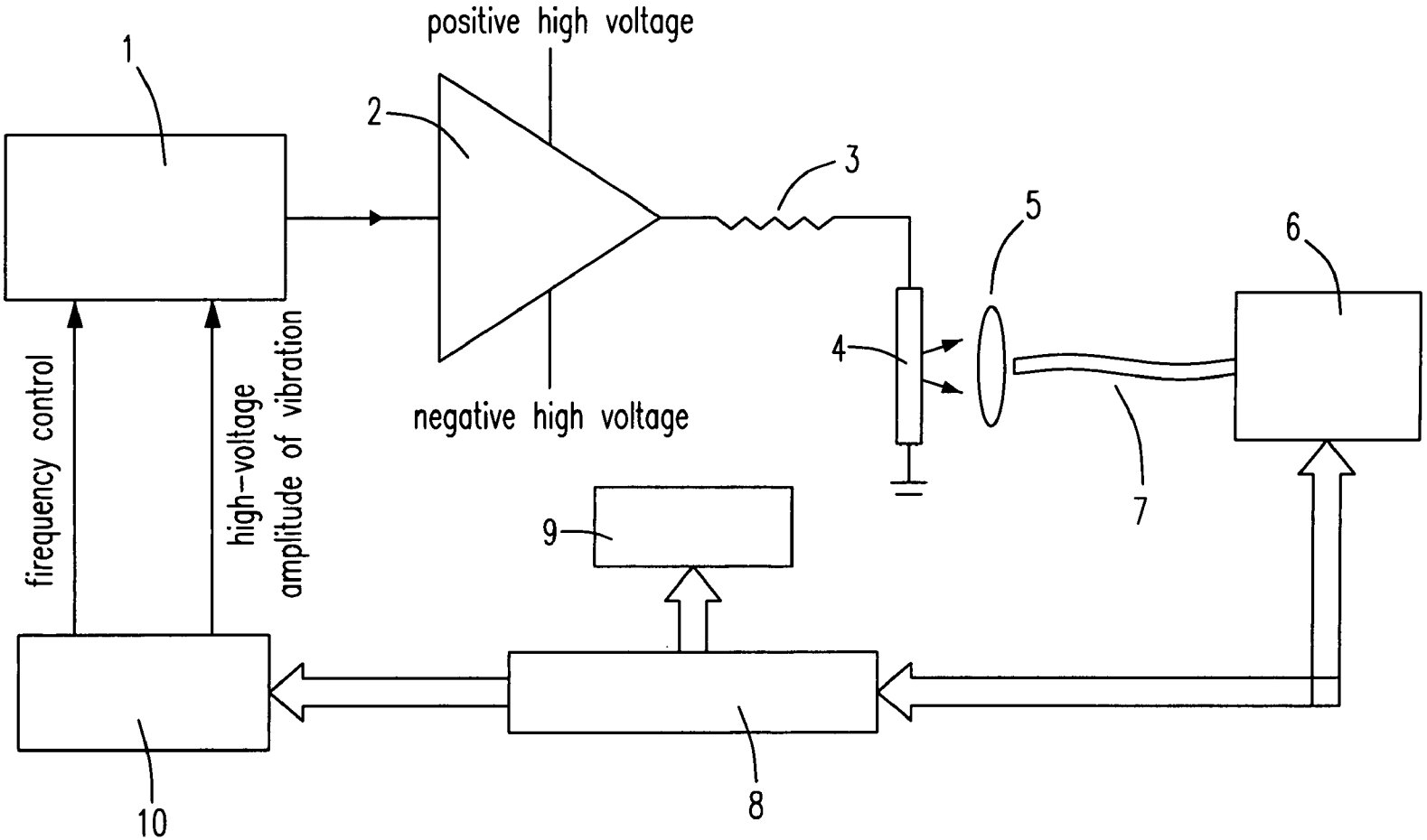
FIG. 1 is a schematical view showing the detecting apparatus for the cold cathode apparatus according to a preferred embodiment of the present invention.

The present invention will now be described more specifically with reference to the following embodiments. It is to be noted that the following descriptions of preferred embodiments of this invention are presented herein for the purpose of illustration and description only; it is not intended to be exhaustive or to be limited to the precise form disclosed.

Please refer to FIG. 1 showing a detecting apparatus for a lamp according to the preferred embodiment of the present invention. The detecting apparatus is constructed by a voltage-controlled frequency and gain controller 1, a voltage operational amplifier 2, a resistance 3, a cold cathode lamp 4, a lens 5, a spectrometer 6, an optical fiber 7, a central processing unit 8, a display 9, and a digital/analog transmitter 10.

According to the present invention, a voltage-controlled frequency and gain controller 1 receives an analog signal to perform the relative frequency and amplitude, then the received signal is linear amplified by the voltage operational amplifier 2 in order to motivate the, cold cathode lamp 4 (or other detecting subject). A resistance 3 between the voltage operational amplifier 2 and the cold cathode lamp 4 is for protecting the amplifier 2. The fluorescence from the cold cathode lamp 4 is focused onto the optical fiber 7 by the lens 5, and then is conducted into the spectrometer 6. Moreover, the central processing unit 8 reveals the spectrum fluorescent signal, which is analyzed by the spectrometer 6, on the display 9 so as to determine whether the cold cathode lamp 4 is on the optimal operating frequency and voltage or not. The central processing unit 8 transfers the scanning data into an analog signal through the digital/analog transmitter 10 and adjusts the optimal detecting frequency and operating voltage.

In conclusion, the present invention provides a detecting apparatus being able to find out the optimal operating frequency and voltage for each cold cathode lamp automatically. The driving circuits of the cold cathode lamp for the backlight source product could be assembled easily and quickly in the correct components. The time spent for testing and quality control would be saved. The purpose of present invention is achieved by increasing the correction rate of the driving circuit of the backlight source product with the cold cathode lamp and the time spent for the modified testing and quality control is able to be saved.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A detecting apparatus for a lamp, comprising:

a central processing unit for receiving a spectrum signal and converting said spectrum signal into a digital signal;

a converter for converting said digital signal to an analog signal;

a controller for receiving said analog signal and generating an operating signal;

an amplifier for receiving said operating signal and outputting a voltage signal to activate said lamp;

a display for displaying a condition;

a spectrometer for receiving a light from said lamp and generating a spectrum signal; and a lens between said lamp and a spectrometer for focusing the light from said lamp and transmitting to said spectrometer through an optical fiber, wherein said spectrum signal is analyzed and differentiated such that an operating condition for said lamp is obtained.

2. The detecting apparatus as claimed in claim 1, wherein said lamp is a cold cathode lamp.

3. The detecting apparatus as claimed in claim 1, wherein said operating condition is an optimal operating frequency and a voltage.

4. The detecting apparatus as claimed in claim 1, wherein said converter is a digital/analog transmitter.

5. The detecting apparatus as claimed in claim 1, further comprising a resistance between said amplifier and said lamp for protecting said amplifier.

* * * * *